US008893674B2

(12) United States Patent
Lengfeld et al.

(10) Patent No.: US 8,893,674 B2
(45) **Date of Patent: *Nov. 25, 2014**

(54) VALVE DRIVE TRAIN DEVICE

(75) Inventors: Markus Lengfeld, Winnenden (DE); Jens Meintschel, Bernsdorf (DE); Thomas Stolk, Kirchheim (DE); Alexander von Gaisberg-Helfenberg, Beilstein (DE)

(73) Assignee: Daimler AG, Stuttgart (DE)

( * ) Notice: Subject to any disclaimer, the term of this patent is extended or adjusted under 35 U.S.C. 154(b) by 417 days.

This patent is subject to a terminal disclaimer.

(21) Appl. No.: 12/927,119

(22) Filed: Nov. 5, 2010

(65) Prior Publication Data

US 2011/0079191 A1 Apr. 7, 2011

Related U.S. Application Data

(63) Continuation-in-part of application No. PCT/EP2009/004164, filed on Jun. 10, 2009.

(30) Foreign Application Priority Data

Jun. 20, 2008 (DE) ..... 10 2008 029 349

(51) Int. Cl.
*F01L 1/34* (2006.01)
*F01L 1/053* (2006.01)
*F01L 13/00* (2006.01)

(52) U.S. Cl.
CPC ..... *F01L 1/053* (2013.01); *F01L 2013/0052* (2013.01); *F01L 13/0036* (2013.01)
USPC ..... 123/90.16; 123/90.18

(58) Field of Classification Search
USPC ..... 123/90.18, 90.16
See application file for complete search history.

(56) References Cited

U.S. PATENT DOCUMENTS

| | | | | |
|---|---|---|---|---|
| 5,129,407 | A | 7/1992 | Phillips | |
| 5,289,806 | A * | 3/1994 | Hurr | 123/90.17 |
| 6,474,281 | B1 * | 11/2002 | Walters | 123/90.18 |
| 6,745,736 | B2 * | 6/2004 | Walters | 123/90.18 |
| 7,404,383 | B2 * | 7/2008 | Elendt | 123/90.16 |
| 7,409,938 | B2 * | 8/2008 | Dengler | 123/90.18 |
| 7,472,671 | B2 * | 1/2009 | Elendt et al. | 123/90.6 |
| 8,161,930 | B2 * | 4/2012 | Elendt et al. | 123/90.6 |
| 8,186,320 | B2 * | 5/2012 | Schiepp et al. | 123/90.18 |
| 8,191,524 | B2 * | 6/2012 | Elendt et al. | 123/90.6 |

(Continued)

FOREIGN PATENT DOCUMENTS

| | | |
|---|---|---|
| CN | 1985074 A | 6/2007 |
| DE | 196 11 641 | 6/1997 |

(Continued)

*Primary Examiner* — Thomas Denion
*Assistant Examiner* — Steven D Shipe
(74) *Attorney, Agent, or Firm* — Klaus J. Bach

(57) ABSTRACT

In a valve train device, particularly of an internal combustion engine, which device has an actuating device for displacing at least one axially displaceable cam element and a cam element shifting gate for axially displacing the cam element and furthermore at least one switch unit with a switch element and an actuator for operating the switch element so as to engage the cam element shifting gate at least in one switching position and to move the switch element into a desired switching position, the cam element shifting gate has at least one intermediate segment for terminating a switching action.

15 Claims, 7 Drawing Sheets

(56) References Cited

U.S. PATENT DOCUMENTS

| | | | | |
|---|---|---|---|---|
| 2003/0051687 | A1* | 3/2003 | Walters | 123/90.18 |
| 2003/0192496 | A1* | 10/2003 | Walters | 123/90.18 |
| 2007/0178731 | A1* | 8/2007 | Elendt | 439/157 |
| 2007/0204819 | A1* | 9/2007 | Elendt et al. | 123/90.16 |
| 2008/0149059 | A1* | 6/2008 | Murphy et al. | 123/90.39 |
| 2008/0236526 | A1* | 10/2008 | Yamamoto et al. | 123/90.16 |
| 2009/0071427 | A1* | 3/2009 | Mock et al. | 123/90.18 |
| 2010/0108006 | A1* | 5/2010 | Elendt et al. | 123/90.17 |
| 2010/0175652 | A1* | 7/2010 | Schoeneberg et al. | 123/90.21 |
| 2010/0180843 | A1* | 7/2010 | Meintschel et al. | 123/90.15 |
| 2010/0199934 | A1* | 8/2010 | Meintschel et al. | 123/90.15 |
| 2010/0199935 | A1* | 8/2010 | Lengfeld et al. | 123/90.15 |
| 2010/0237264 | A1* | 9/2010 | Lengfeld et al. | 251/89 |
| 2010/0251982 | A1* | 10/2010 | Elendt et al. | 123/90.18 |
| 2010/0269769 | A1* | 10/2010 | Schoeneberg et al. | 123/90.6 |
| 2011/0079188 | A1* | 4/2011 | Meintschel et al. | 123/90.15 |
| 2011/0079190 | A1* | 4/2011 | Meintschel et al. | 123/90.17 |
| 2011/0079191 | A1* | 4/2011 | Lengfeld et al. | 123/90.18 |
| 2011/0185995 | A1* | 8/2011 | Deblaize et al. | 123/90.18 |
| 2012/0031361 | A1* | 2/2012 | Ickinger et al. | 123/90.18 |
| 2012/0125274 | A1* | 5/2012 | Werler et al. | 123/90.15 |
| 2012/0138000 | A1* | 6/2012 | Schadel et al. | 123/90.18 |
| 2012/0138001 | A1* | 6/2012 | Werler et al. | 123/90.18 |
| 2012/0235777 | A1* | 9/2012 | Elendt et al. | 335/229 |

FOREIGN PATENT DOCUMENTS

| | | | | | |
|---|---|---|---|---|---|
| DE | 196 11 641 | C1 | | 6/1997 | |
| DE | 101 48 177 | | | 4/2003 | |
| DE | 101 48 177 | A1 | | 4/2003 | |
| DE | 102004022832 | A1 | * | 12/2005 | |
| DE | 102006051809 | A1 | * | 5/2008 | |
| DE | 102007024598 | A1 | * | 11/2008 | H01F 7/124 |
| DE | 102007024600 | A1 | * | 11/2008 | F01L 13/00 |
| DE | 102008020892 | A1 | * | 10/2009 | F01L 13/00 |
| DE | 102008020893 | A1 | * | 10/2009 | F01L 13/00 |
| DE | 102008024911 | A1 | * | 11/2009 | F01L 1/047 |
| DE | 102008054254 | A1 | * | 5/2010 | F01L 1/047 |
| DE | 102009007819 | A1 | * | 8/2010 | |
| DE | 102009053116 | A1 | * | 9/2010 | |
| DE | 102010013216 | A1 | * | 10/2010 | |
| DE | 102009021650 | A1 | * | 11/2010 | |
| GB | 10 648 | | | 0/1912 | |
| GB | 10648 | | | 10/2012 | |
| JP | 2010 535966 | | | 11/2010 | |
| WO | 2005/080761 | A1 | | 9/2005 | |
| WO | WO 2005/080761 | | | 9/2005 | |

* cited by examiner

VALVE DRIVE TRAIN DEVICE

This is a continuation-in-part application of pending international patent application PCT/EP2009/004164 filed Jun. 10, 2009 and claiming the priority of German patent application 10 2008 029 349.0 filed Jun. 20, 2008.

BACKGROUND OF THE INVENTION

The invention relates to a valve drive train including an actuation device for moving an axially displaceable cam element via a shifting gate and a switch element for controlled engagement in the shifting gate.

A valve drive train device, in particular of an internal combustion engine, is already known. It includes an actuation device which is provided to move at least one axially displaceable cam element, and which has at least one first switch unit with a first switch element and a first actuator, wherein the switch element is provided to engage a gear shifting gate in at least one switching position, and the actuation device is controlled to move the switch element into a switching position.

It is the object of the present invention to provide a valve train device by means of which different switching positions can be switched in a simple manner.

SUMMARY OF THE INVENTION

In a valve train device, particularly of an internal combustion engine, which device has an actuating device for displacing at least one axially displaceable cam element and a cam element shifting gate for axially displacing the cam element and furthermore at least one switch unit with a switch element and an actuator for operating the switch element so as to engage the cam element shifting gate at least in one switching position and to move the switch element into a desired switching position, the cam element shifting gate has at least one intermediate segment for terminating a switching action.

"Provided" is in particular meant to be especially equipped, designed and/or programmed. "Terminating" in this connection is meant to relate in particular to a premature termination, an interruption or a breaking off. A "switching action" is in particular meant to be a displacement of the cam element. A "cam element shifting gate" is further in particular meant to be an arrangement which converts a rotary movement of the cam element into an axial force for adjusting the axial position of the cam element. The cam element shifting gate preferably has at least one gate path, accommodating an axially fixed switch pin which generates the axial force by means of the cam element shifting gate. An "intermediate segment" is in particular meant to be a segment of the cam element shifting gate, or in particular a segment of the gate path, which is preceded by at least one further segment and after which follows at least one further segment. An intermediate segment is thereby in particular not meant to be the last segment of the cam element shifting gate or of the gate path. By an arrangement according to the invention, a switch element of a switch unit can be displaced back into a neutral position at different times of the switching action and a switching action that has already been started can be terminated, whereby in particular different switching positions can be switched in a simple manner, The intermediate segment is preferably further provided to continue the switching action.

It is further suggested that the intermediate segment is provided to move a switch element of a switch unit into a neutral position. The switching action can thereby be terminated in a particularly simple manner. In particular, an actuator system which is provided to move the switch element into the neutral position is thereby not needed. It is suggested in particular that the intermediate segment has an increasing radial height in at least one partial section. The switch element can thereby be moved into the neutral position in a simple manner. A "radial height" is in particular meant to be a radial distance between a gate path base and a gate path base level, wherein a "gate path base level" is meant to be a radial level of a point of the gate path, which has a minimum distance from a rotational axis. With a positive gear shifting gate, which has in particular a gate path, which is designed as an elevation extending around the cam element, the radial height is in particular meant to be a height of the gate path base above the cam element. With a negative gear shifting gate, which has in particular a gate path designed as a groove, the radial height corresponds in particular to a radial depth, wherein an increasing radial height corresponds to a decreasing radial depth.

It is further suggested that the intermediate segment has a reset element which is provided to move the switch element into the neutral position. A reset unit for the switch element can be realized in a simple manner by means of a reset element. The reset element is preferably designed as a radial elevation above the gate path base level and has in particular the increasing radial height.

It is in particular advantageous if the intermediate segment has a radial extension which is always unequal to zero. An advantageous guidance of the switch element can be realized thereby, which guides the switch elements in particular also in the region of the reset elements. A "radial extension" is in particular meant to be a radial distance between the gate path base and the cam element shifting gate base level. With a negative gate path, the radial extension corresponds to the radial depth. With a positive gate path, the radial extension corresponds to the radial height plus a base height by which the gate path base level lies above the gear shifting gate base level.

In an advantageous further development of the invention it is suggested that the cam element shifting gate has at least one disengagement segment which is provided to conclude the switching action. The switching action can thereby be concluded in an advantageous manner when an end position is reached.

It is suggested in particular that the disengagement segment and the intermediate segment are separated from each other. A switching position and an end switching position can thereby be viewed separately from each other in a simple manner. A disengagement segment is in particular meant to be a segment whose radial height adapts to a gear shifting gate base level.

It is further suggested that the gear shifting gate has at least one switch segment which is arranged between the disengagement segment and the intermediate segment. A further switching action can thereby be connected to the intermediate segment in an advantageous manner, whereby in particular a switch time can be shortened over several switching positions.

It is furthermore suggested that the actuation device is provided to switch the cam element in at least three switching positions. A valve train device can thereby be realized which can be adapted to different operating modes of the internal combustion engine in a flexible manner due to a high number of switching positions.

It is further suggested that the actuation device has at least one actuator which is provided to move the first switch element into a neutral position. A "cam element shifting gate" is in particular meant to be an arrangement which converts a rotary movement of the cam element into an axial force for adjusting the cam element, wherein the cam element shifting gate preferably has at least one gate path into which advantageously meshes an axially fixed switch pin which generates the axial force by means of the cam element shifting gate. A "switching position" of the switch element is thereby in particular meant to be a position in which the switch element is in engagement with the cam element shifting gate, in particular in engagement with the gate path of the cam element shifting gate. A "neutral position" of the switch element is further meant to be a position in which the switch element is outside an engagement into the cam element shifting gate. An "actuator" is in particular meant to be a unit which is provided to activate a switching action in dependence on a control parameter, in particular in dependence on a control signal. The actuator shall in particular be provided to carry out mechanical work in dependence on the control parameter. As a control parameter, which is preferably formed as a control signal, an electrical or an electronic signal is in particular advantageous, which is preferably issued by means of a control unit and in dependence thereon a mechanical structure of the switch unit is switched. Electrical, thermal, chemical, hydraulic and/or pneumatic actuators are for example conceivable as actuators. "Provided" is in particular meant to be especially programmed, designed and/or designed. By means of an arrangement according to the invention, the switch element can be displaced back into the neutral position independently of an arrangement of the cam element shifting gate, and a switching action already started can be stopped or interrupted.

Such an actuation device is in particular advantageous for a valve train device which has a shifting gate with a disengagement segment which is provided to move the switch element back into the neutral position. An actuation device according to the invention is further advantageous in particular for a valve train device with two cam elements which are sequentially displaced in a switching action, as it can be achieved thereby that the cam elements are in different switching positions. Such an actuation device is further in particular advantageous for and actuation device which can displace the at least one cam element in three switching positions, as the switching action can simply be stopped after a displacement from a first switching position into a second switching position. A valve train device with two cam elements which can respectively be displaced independently of each other in three switching positions can be realized in a particularly advantageous manner.

It is further suggested that the at least one actuator is formed in an electromagnetic manner. A more cost-efficient actuator which can be activated in a simple manner can thereby be provided. It is thereby suggested in particular that the actuator which is provided to move the first switch element back into a neutral position is also formed as an electromagnetic actuator. Preferably, all actuators of the actuation device are formed as electromagnetic actuators.

The first switch unit is advantageously provided to displace the at least one cam element into a first switching direction. A simple actuation device can be provided thereby. It is suggested in particular that the switch unit is provided to displace the at least one cam element only into the first switching direction, wherein the switch unit is provided in a particularly advantageous arrangement to displace all cam elements into the first switching direction. In order to displace the cam element from one switch position into another switch position, the switch element is preferably moved into its switching position, whereby it engages the cam element shifting gate and exerts an axial force on the cam element for adjusting the cam element. If the switch element is in its neutral position, the cam element remains in its switching position.

It is further suggested that the valve train device has a second switch unit with a second switch element which is provided to engage the cam element shifting gate at least in a switching position. A flexibility of the actuation device can be increased thereby.

The second switch element is preferably provided to displace the at least one cam element into a second switching direction. A constructively simple actuation device can be provided thereby, which can displace the at least one cam element into two switching directions, wherein the second switching direction is advantageously opposite to the first switching direction. The second switch unit is in particular intended to displace the at least one cam element only into the second switching direction.

In an advantageous arrangement, the second switch unit has an actuator which is provided to move the second switch element into a switching position. The further switch element can thereby be moved in a simple manner, wherein the second actuator is preferably designed analogously to the first actuator.

It is particularly advantageous if the actuator of the second switch unit is designed at least partially in one part with the actuator, which is provided to move the first switch element into the neutral position. An additional actuator which is only provided for a reset into the neutral position can thereby be foregone, whereby the costs for the actuation device can be reduced.

In a further embodiment of the invention it is suggested that the first actuator is provided to move the second switch element into a neutral position. The second switch element can thereby advantageously also be reset independently of the gear shifting gate.

The actuation device advantageously has a coupling element which is provided to couple the first switch element and the second switch element in an interactive manner. A particularly advantageous arrangement according to the invention can be achieved thereby, in which in particular a switching action can be interrupted independently of the switching direction.

It is suggested in particular that the coupling element is provided to couple the first switch element and the second switch element in a complementary manner. A movement of the one switch element can thereby advantageously be used to move the other switch element into the neutral position.

It is further suggested to design the first switch unit and the second switch unit at least partially in one piece. Construction costs and components for the actuation device can be saved thereby.

It is suggested in particular that the first switch unit and the second switch unit have at least one common base housing part. A design with an advantageously small installation space can be formed thereby. It is thereby in particular advantageous if the two actuators are arranged in the common base housing part.

It is further suggested that the first switch unit and the second switch unit have a common stator. A particularly simple design can be achieved thereby.

It is furthermore suggested that the actuation device is provided to switch the cam element in at least three switching positions. A valve train device can thereby be realized that can be adapted in a flexible manner to different operating modes of the internal combustion engine due to a high number of switching positions.

Further advantages will become apparent from the following description of the invention on the basis of the accompanying drawings, which show an embodiment of the invention. The drawings, the description and the claims contain numerous characteristics in combination. The expert will conveniently also view the characteristics individually and combine them to sensible further combinations.

BRIEF DESCRIPTION OF THE DRAWINGS

It is shown in.

DESCRIPTION OF PARTICULAR EMBODIMENTS

Figure 1:
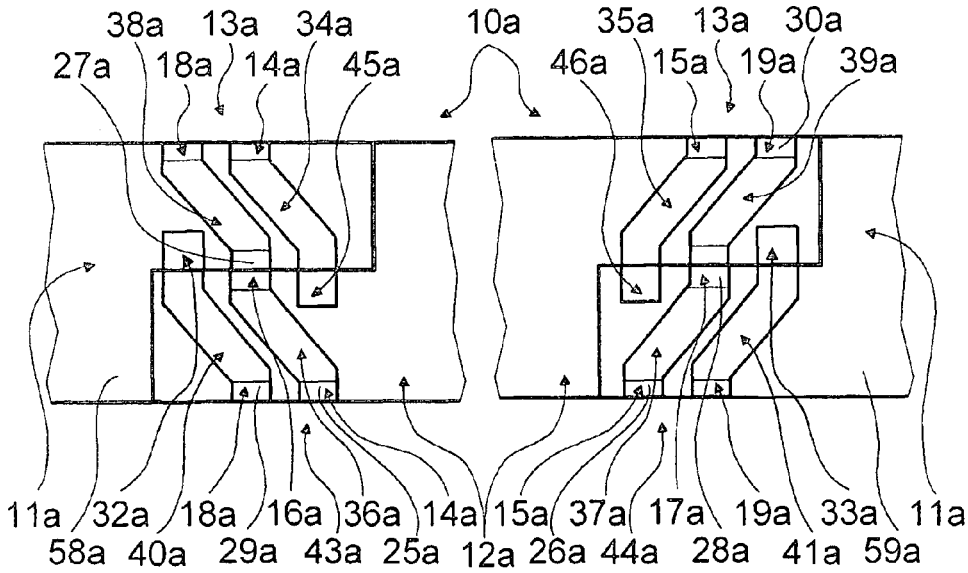
FIG. 1 schematically a gear shifting gate of an actuation device of a valve train device in a planar view, FIG. 2 a gate path of the gear shifting gate in a cross section, FIG. 3 the valve train device in a schematized overview, FIG. 4 a switch unit of the actuation device, FIG. 5 a gate path of a further gear shifting gate, FIG. 6 an actuation device of a valve train device with two switch units in a cross sectional view, FIG. 7 the actuation device in a perspective depiction, FIG. 8 schematically a gear shifting gate in a planar view, and FIG. 9 a schematized overview of the valve train device.
Figure 3:
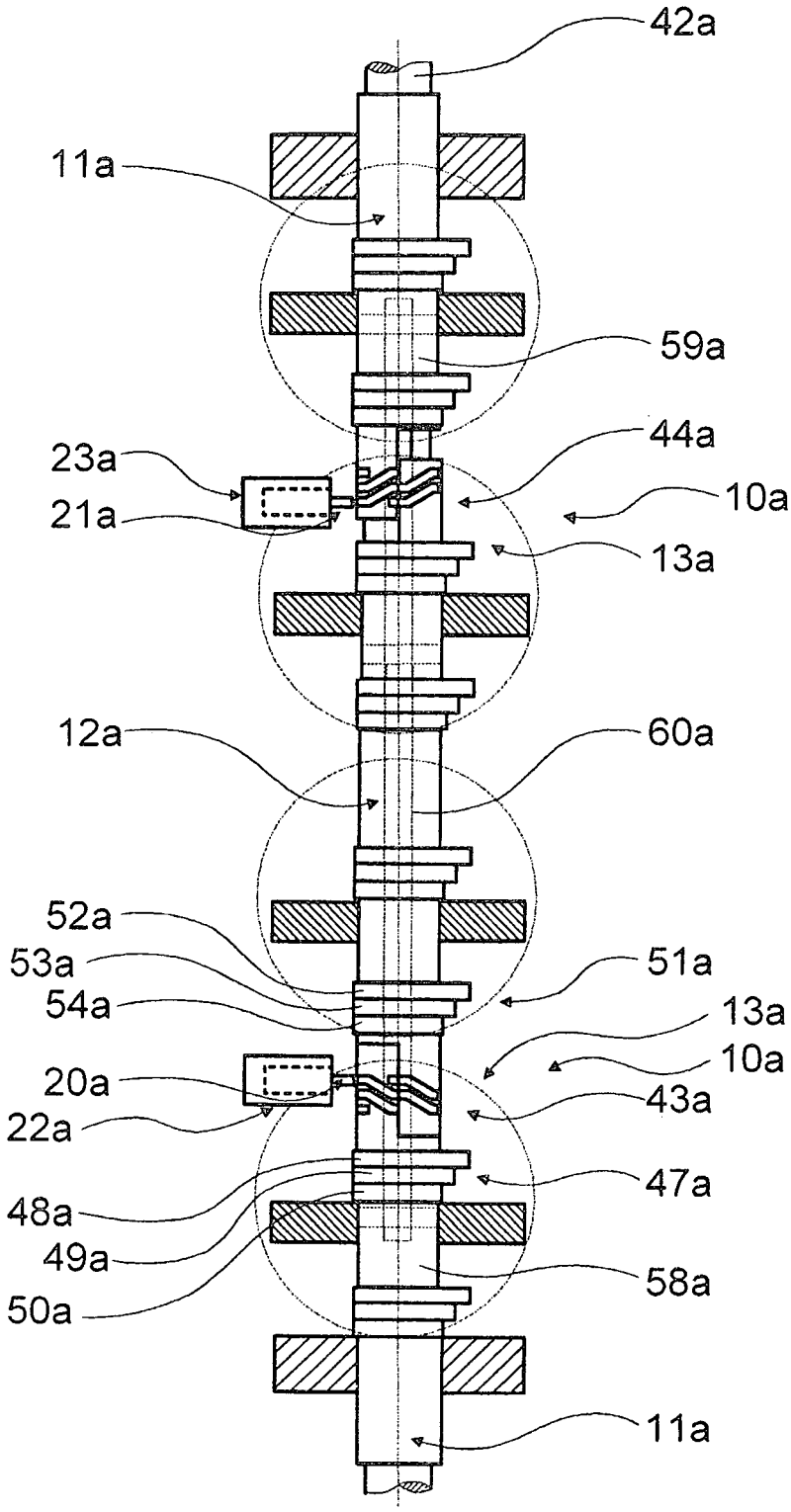

FIG. 1 shows a gear shifting gate 13*a* of an actuation device 10*a* of a valve train device. The actuation device 10*a* is provided to move two cam elements 11*a*, 12*a* which are arranged on a base camshaft 42*a* in an axially displaceable and torque-proof manner. In order to move the cam elements 11*a*, 12*a*, the actuation device 10*a* has a first switch unit 22*a* and a second switch unit 23*a* (FIG. 3), which can displace the cam elements 11*a*, 12*a* by means of the gear shifting gate 13*a*.

The gear shifting gate 13*a* has a first gate path 43*a* and a second gate path 44*a*. The gate paths 43*a*, 44*a*, by means of which the cam elements 11*a*, 12*a* can be displaced, are designed as groove-shaped recesses and are formed directly into the cam elements 11*a*, 12*a*. In order to displace the cam elements 11*a*, 12*a* sequentially, the cam elements 11*a*, 12*a* are designed L-shaped and intersecting axially in a region where they abut (see FIG. 3). In the circumferential direction, each cam element 11*a*, 12*a* extends over a rotary angle of 180° in the region of the gate paths 43*a*, 44*a*. The gate paths 43*a*, 44*a*, which extend over a rotary angle larger than 359°, are respectively arranged partially on the cam element 11*a* and partially on the cam element 12*a*.

Both gate paths 43*a*, 44*a* have a base shape with a fourfold S-shaped structure (see FIG. 1). Both gate paths 43*a*, 44*a* respectively have a meshing segment 45*a*, 46*a*, four switch segments 34*a*-41*a*, three intermediate segments 14*a*-19*a* and a disengagement segment 32*a*, 33*a*. The switch segments 34*a*, 36*a*, 38*a*, 40*a* of the first gate path 43*a* have an axial direction component which is opposed to a first switching direction, whereby an axial force for switching into the first switching direction can be generated by means of the switch segments 34*a*, 36, 38*a*, 40*a* and a rotary movement of the cam element 11*a*. The switch segments 35*a*, 37*a*, 39*a*, 41*a* of the second gate path 44*a* have an axial direction component, which is axially opposed to a second switching direction, whereby an axial force for switching into the second switching direction can analogously be generated.

In the first gate path 43*a*, one of the switch segments 34*a*, 36*a*, 38*a*, 40*a* and one of the intermediate segments 14*a*, 16*a*, 18*a* are arranged in the following alternately, wherein the switch element 34*a* immediately follows the meshing segment 45*a*. The disengagement segment 32*a* is arranged immediately following the last switch element 40*a*. The meshing segment 45*a* has an increasing radial depth. The switch segments 34*a*, 36*a*, 38*a*, 40*a* have a constant radial depth. The disengagement segment 33*a* has a decreasing radial depth. By means of the decreasing radial depth of the disengagement segment 33*a*, a switch element 20*a* of the first switch unit 22*a* is moved back into its neutral position, in which it is outside an engagement into the gear shifting gate.

The meshing segment 45*a*, the intermediate segments 14*a*, 16*a*, 18*a* and the disengagement segment 32*a* are respectively partially arranged on the cam element 11*a* and partially on the cam element 12*a*. The switch segments 34*a*, 36*a*, 38*a*, 40*a* are respectively completely arranged on a cam element 11*a*, 12*a*, wherein switch segments 34*a*, 36*a*, 38*a*, 40*a* following each other are alternately arranged on the cam elements 11*a*, 12*a*. The switch segment 34*a* and the switch segment 38*a* are provided to displace the cam element 11*a*. The switch segment 36*a* and the switch segment 40*a* are provided to displace the cam element 12*a*

The second gate path 44*a* is formed analogously to the first gate path 43*a*. Following the meshing segment 46*a*, one of the switch segments 35*a*, 37*a*, 39*a*, 41*a* and one of the intermediate segments 15*a*, 17*a*, 19*a* are also arranged alternately. The disengagement segment 33*a* immediately follows the last switch segment 41*a*. The meshing segment 46*a*, the intermediate segments 15*a*, 17*a*, 19*a* and the disengagement segment 33*a* are respectively partially arranged on the cam element 11*a* and partially on the cam element 12*a*. The switch segments 35*a*, 37*a*, 39*a*, 41*a* are respectively completely arranged on one of the cam elements 11*a*, 12*a*, wherein successive switch segments 35*a*, 37*a*, 39*a*, 41*a* are alternately arranged on one of the cam elements 11*a*, 12*a* which they can displace.

Figure 2:
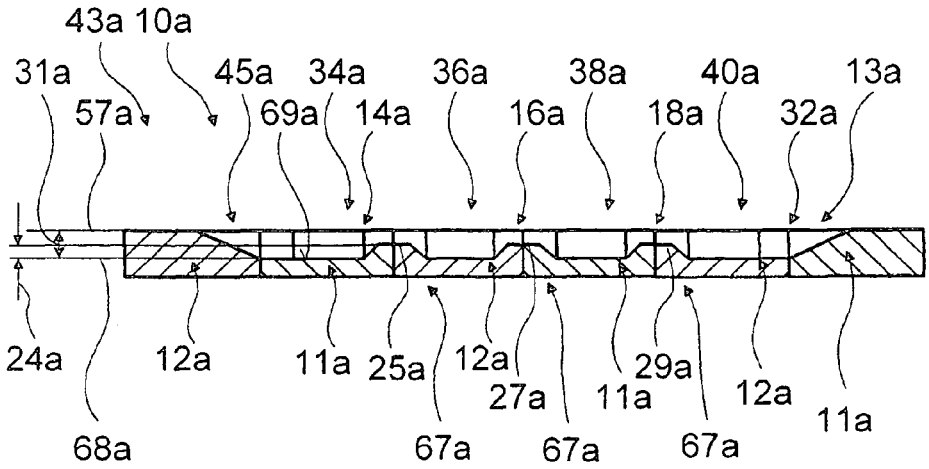
Figure 4:
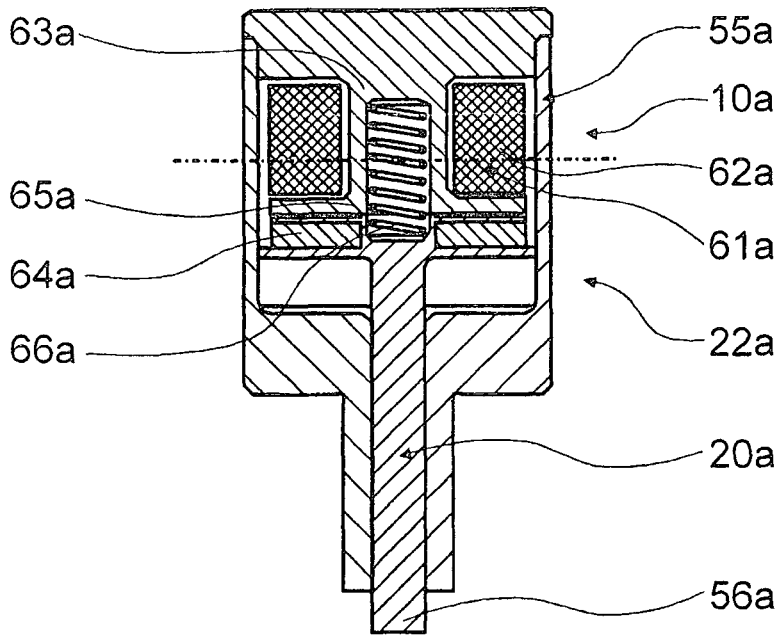

Three different switching positions of the cam elements 11*a*, 12*a* can be switched by means of the switch segments 34*a*-41*a* (see FIG. 4 2). The cam element 11*a* and the cam element 12*a* respectively have at least one cam unit 47*a*, 51*a* with three partial cams 48*a*-50*a*, 52*a*-54*a*. The partial cams 48*a*-50*a*, 52*a*-54*a* have a different lift height and can be assigned to switching positions of the cam elements.

The partial cams 48*a*-50*a*, 52*a*-54*a* with the highest lift height are assigned to switching positions with a full lift. The partial cams 49*a*, 53*a* with a median lift height are assigned to switching positions with a partial lift. The partial cams 50*a*, 54*a* with the lowest lift height, which is advantageously equal to zero, are assigned to switching positions with a zero lift. The partial cams 48*a*, 52*a* with the highest lift height and the partial cams 50*a*, 54*a* with the lowest lift height are arranged on the outside in the corresponding cam units 47*a*, 51*a*. The partial cams 49*a*, 53*a* with the median lift height are arranged between the other partial cams 48*a*, 50*a*, 52*a*, 54*a* of the corresponding cam unit 47*a*, 51*a*.

For displacing the cam elements 11*a*, 12*a*, the actuation device 10*a* has the two switch units 22*a*, 23*a*. The first switch unit 22*a* (FIG. 4) has a first actuator 55*a* and the first switch element 20*a*. The switch element 20*a* is partially formed as a switch pin 56*a*, which is extended in a switching position of the first switch element 20*a*. In the switching position, the switch pin 56*a* engages the first gate path 43*a* of the gear shifting gate 13*a*. The cam elements 11*a*, 12*a* can be displaced into the first switching direction by means of the first switch unit 22*a* and the first gate path 43*a*.

The first actuator 55*a*, which moves the first switch element 20*a*, has an electromagnetic unit 61*a*. The electromagnetic unit 61*a* comprises a solenoid 62*a*, which is arranged in a stator 63*a* of the electromagnetic unit 61*a*. A magnetic field can be generated by means of the solenoid 62*a*, which field interacts with a permanent magnet 64*a*, which is arranged in the switch element 20*a*. The switch element 20*a* can thereby be extended with the switch pin 56*a*. A core 65*a* amplifies the magnetic field generated by the electromagnetic unit 61*a*.

If the solenoid 62*a* has no current, the permanent magnet 64*a* interacts with the surrounding material. In the neutral position, the permanent magnet 64*a* interacts with the core 65*a* of the electromagnetic unit 61*a*, which consists of a magnetizable material. In the switching position, the permanent magnet 64*a* interacts with the stator 63*a* of the actuator 55*a*. In an operating state without current, the permanent magnet 64*a* stabilizes the switch element 20*a* in the switching position or the neutral position.

In an operating state, in which the electromagnetic unit 61*a* is supplied with a current, the permanent magnet 64*a* interacts with the field of the electromagnetic unit 61*a*. Depending on a polarization of the permanent magnet 64*a* and the electromagnetic unit 61*a*, an attracting force and a repelling force can be generated thereby. A polarization of the electromagnetic unit 61*a* can be changed by means of a current direction, by means of which the electromagnetic unit 61*a* is supplied with a current. In order to extend the switch element 20*a* from its neutral position into the switch position, the electromagnetic unit 61*a* is supplied with current in the direction, in which the repellent force between the electromagnet unit 61*a* and the permanent magnet 64*a* is generated.

A spring unit 66*a* is further arranged in the actuator 55*a*, which unit also exerts a force on the switch element 20*a*. The force of the spring unit 66*a* is directed into a direction which corresponds to a direction of the repelling force between the electromagnetic unit 61*a* and the permanent magnet 64*a*, whereby an extension action of the switch element 20*a* is accelerated.

The second switch unit 23*a* is analogous to the first switch unit 22*a*. The second switch unit hast a switch pin which engages the gate path 44*a* in a switching position of a switching element 21*a*. By means of the second switch unit 23*a* and the second gate path 44*a*, the cam elements 11*a*, 12*a* can be displaced into the second switch direction opposite the first switch direction.

The cam elements 11*a*, 12*a* are partially coupled to each other via the cam element shifting gate in a movement-technical manner. The cam elements 11*a*, 12*a* can be displaced sequentially by means of the actuation device 10*a*. The cam elements 11*a*, 12*a* are thereby displaced in dependence on a rotary angle of the base camshaft 42*a*. In the first switch direction, the first cam element 11*a* is initially displaced, and subsequently, when the first cam element 11*a* is completely displaced, the second cam element 12*a* is displaced. In the second switch direction, the second cam element 12*a* is initially displaced, and the first cam element 11*a* is subsequently displaced.

The first cam element 11*a* is designed in two parts and has two cam element parts 58*a*, 59*a*, which are arranged on opposite ends of the second cam element 12*a*. The cam element parts 58*a*, 59*a* are rigidly connected to each other by means of an interior coupling bar 60*a* for an axial movement. In principle, it is also conceivable to arrange the two cam element parts 58*a*, 59*a* adjacent to each other and to design them in one piece.

In order to be able to withdraw the switch elements 20*a*, 21*a* at a time which is independent of the disengagement segments 32*a*, 33*a*, each intermediate segment 14*a*-19*a* of the gate paths 43*a*, 44*a* of the cam element shifting gate 13*a* respectively has a reset element 25*a*-30*a* (see FIG. 1). By means of the reset elements 25*a*-30*a*, the switch element 20*a*, 21*a* engaging the corresponding gate path 43*a*, 44*a* can be moved back into its neutral position. The reset elements 25*a*, 30*a* thus form a reset unit 67*a*, by means of which a switching process can be terminated prematurely.

The reset elements 25*a*-30*a* are all designed in the same manner, which is why the following description of the reset element 25*a* can also analogously be transferred to the remaining reset elements. The reset element 26*a* is designed as an elevation over a gate path base level 68*a* and is arranged completely in the gate path 43*a*. In the region of the reset element 26*a*, a radial height 24*a* of a gate path base 69*a* increases or a radial depth of the gate path decreases. A radial extension 31*a* of the gate paths 43*a*, 44*a*, which is formed by a distance between a gear shifting gate base level 57*a* and which corresponds to the radial depth of the gate paths 43*a*, 44*a*, is thereby always larger than zero (see FIG. 2)

The two cam elements 11*a*, 12*a* can be switched to arbitrary switching positions by means of the reset elements 25*a*-30*a*. If for example the first cam element 11*a* shall be switched from the switching position with zero lift into the switching position with full lift and the second cam element 12*a* from the switching position with zero lift into the switching position with partial lift, the first switch element 20*a* is extended and brought into engagement with the first gate path 43*a* by means of the meshing segment 45*a*.

By means of the following switch segment 34*a*, the first cam element 11*a* is moved from the switching position with zero lift into the switching position with partial lift. The intermediate segment 14*a* with the reset element 25*a* follows the switch segment 34*a*. In order to prevent that the switch element 20*a* is moved into the neutral position by means of the reset element 25*a*, the electromagnetic unit 61*a* of the first actuator is energized and the switch element 20*a* follows a contour of the intermediate segment 14*a*. Subsequently, the second cam element 12*a* is moved from the switching position with zero lift into the switching position with partial lift by means of the following switch segment 35*a*. The intermediate segment 15*a* with the reset element 26*a* follows the switch segment 35*a*. While the switch element 20*a* passes through the intermediate segment 15*a*, the actuator 55*a* is again energized and the switch element 20*a* follows a contour of the intermediate segment 15*a*. By means of the following switch segment 36*a*, the first cam element 11*a* is switched from the switching position with partial lift into the switching position with full lift. The intermediate segment 16*a* with the reset element 27*a* follows the switch segment 36*a*. While the switch element 20*a* passes through the intermediate segment 16*a*, the actuator 55*a* does not need to be energized. The switch element 20*a* is thereby moved back into its neutral position by the reset element 27*a*, whereby the switch element 20*a* is outside an engagement into the gate path 43*a* and the second cam element 12*a* remains in the switching position with partial lift.

Further switching actions can be realized analogously to the depicted switching process. As these proceed according to the same scheme and result immediately from the above description or the figures, a detailed description is not needed here.

Figure 5:
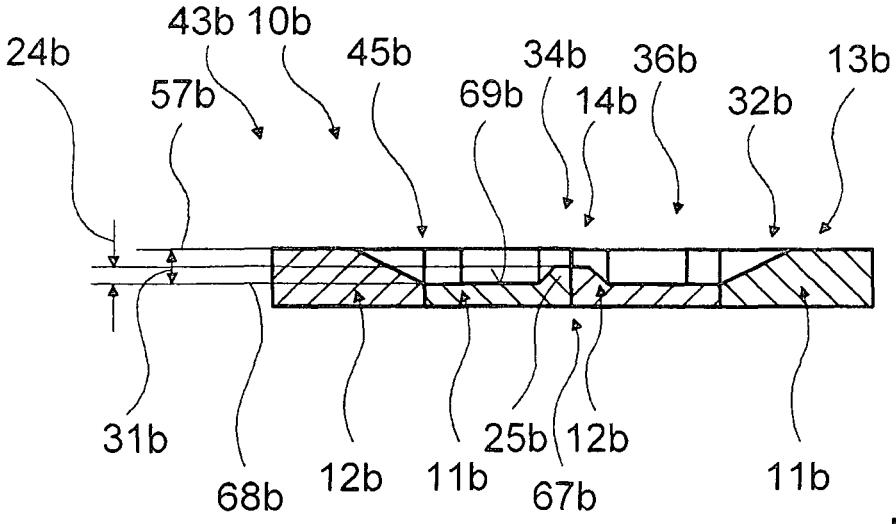

FIG. 5 shows a gate path 436 of a cam element shifting gate 13*b*, which respectively has a switch segment 34*b*, 36*b* for each cam element 11*b*, 12*b*, by means of which the corresponding cam element 11*b*, 12*b* can be moved from a switching position with partial lift to a switching position with full lift. With such an arrangement, an intermediate segment 14*b* with a reset element 25*b* can advantageously be used to switch the one cam element 11*b* into the switching position with partial lift and the other cam element 12*b* into the switching position with full lift.

A second gate path 12*b* of the gear shifting gate, by means of which the cam elements 11*b*, 12*b* can be moved from the switching position with full lift into the switching position with partial lift, is designed in an analogous manner and not shown here in further detail.

Figure 6:
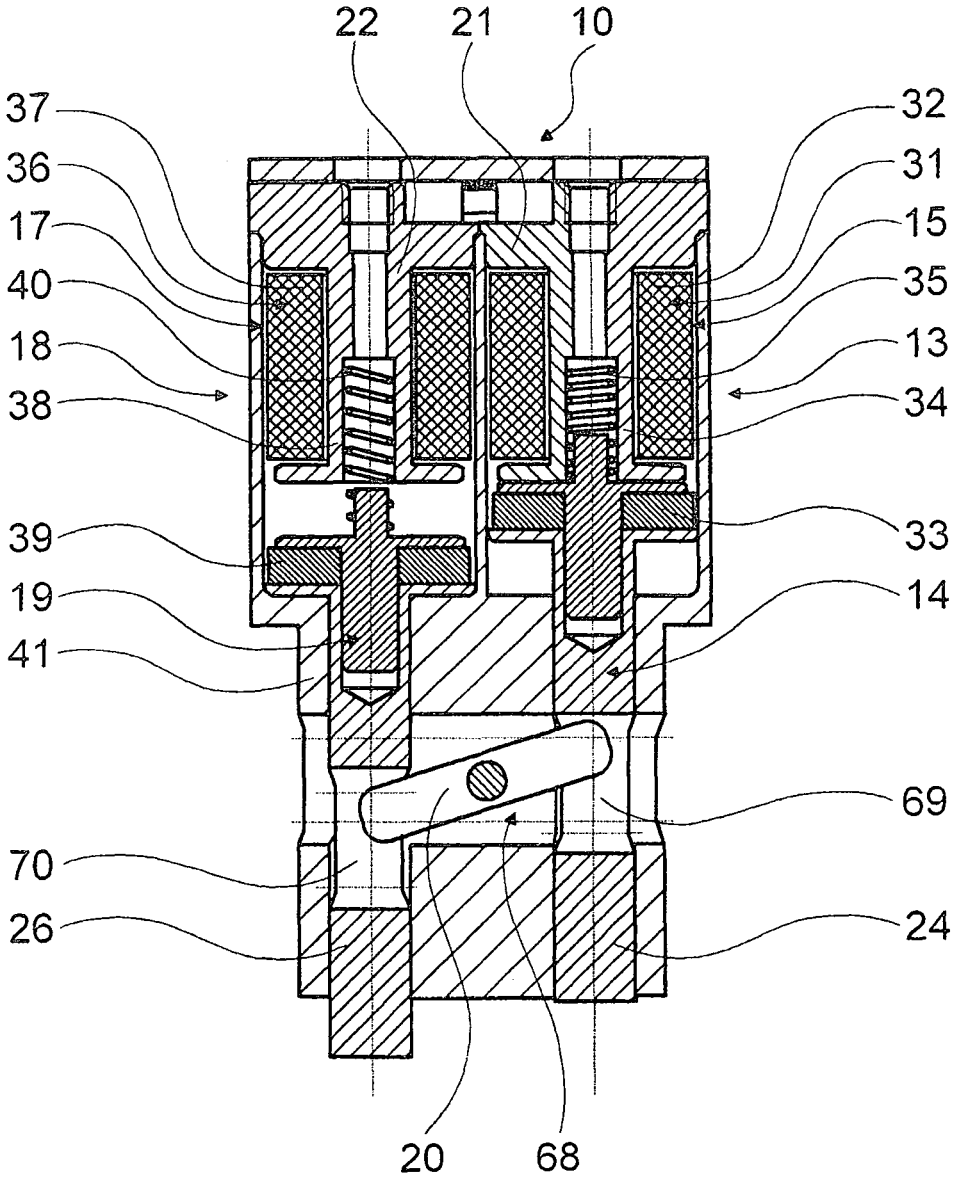
Figure 7:
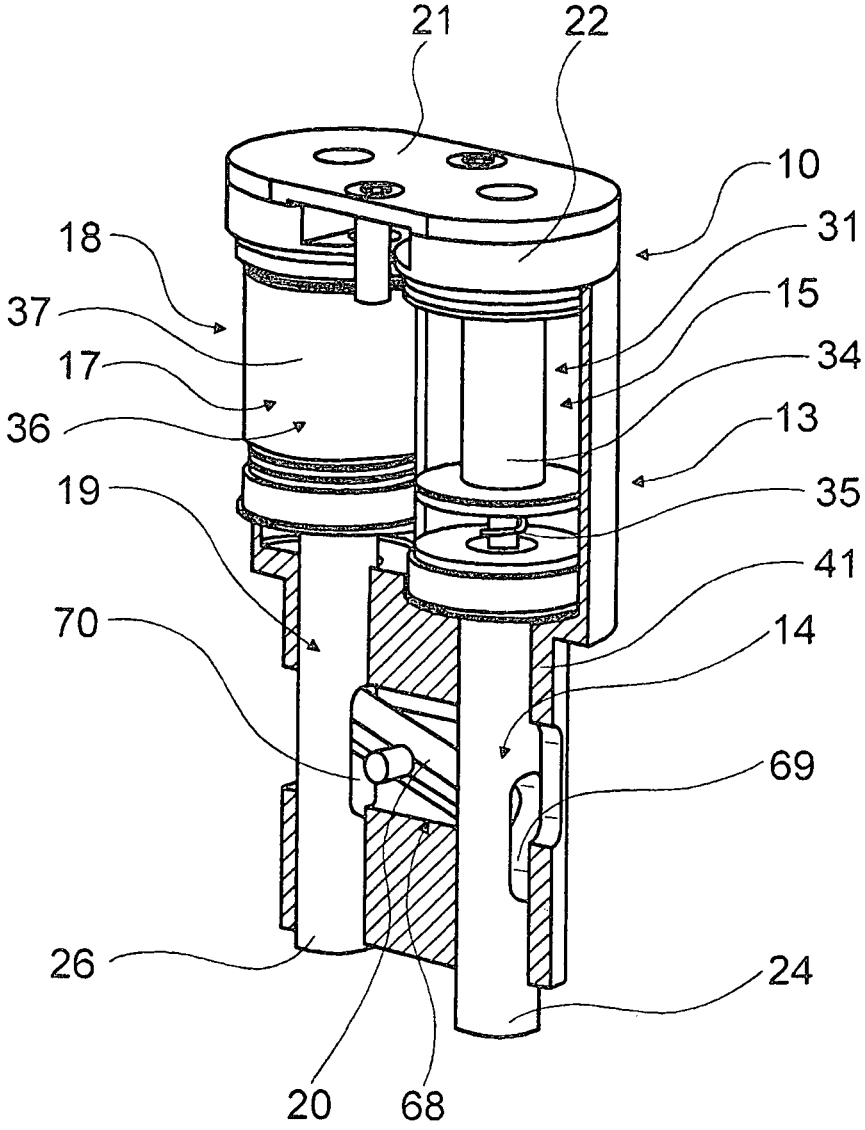

FIG. 6 and FIG. 7 show an actuation device 10 of a valve train device. The actuation device 10*a* is provided to move two cam elements 11, 12 which are arranged on a base camshaft 23 in an axially displaceable and torque-proof manner. In order to move the cam elements 11, 12, the actuation device 10 has a first and a second switch unit 13, 18, which can displace the cam elements 11, 12 by means of the cam element shifting gate 16.

The first switch unit 13 has a first actuator 15 and the first switch element 14. The switch element 14 is partially formed as a switch pin 24, which is extended in a switching position of the first switch element 14. In the switching position, the switch pin 24 engages a first gate path 25 of the cam element shifting gate 16. The cam elements 11, 12 can be displaced into a first switching direction by means of the first switch unit 13.

The second switch unit 18 has a second actuator 17 and a second switch element 19. The second switch element 19 is also formed partially as a switch pin 26, which is extended in a switching position of the second switch element 19. In the switching position, the switch pin 26 engages a second gate path 27 of the cam element shifting gate 16. By means of the second switch unit 18 and the second gate path 27, the cam elements 11, 12 can be displaced into a second switch direction opposed to the first switch direction.

The cam elements 11, 12 are partially coupled to each other via the cam element shifting gate 16 in an interactive manner. The cam elements 11, 12 can be displaced sequentially by means of the actuation device 10. The cam elements 11, 12 are thereby displaced in dependence on a rotary angle of the base camshaft 23. In the first switching direction, the first cam element 11 is displaced initially, and subsequently, when the first cam element 11 is completely displaced, the second cam element 12 is displaced. In the second switching direction, the second cam element 12 is displaced initially, and the first cam element 11 is displaced subsequently.

The first cam element 11 is designed in two parts and has two cam element parts 28, 29, which are arranged on both sides of the second cam element 12. The cam element parts 28, 29 are rigidly connected to each other by means of an interior coupling bar 30 for an axial movement. In principle, it is also conceivable to arrange the two cam element parts 28, 29 adjacent to each other and to design them in one piece.

The first actuator 11*a*, which moves the first switch element 14, has an electromagnetic unit 31. The electromagnetic unit 31 comprises a solenoid 32, which is arranged in a stator 22 of the electromagnetic unit 31. A magnetic field can be generated by means of the solenoid 32, which field interacts with a permanent magnet 33, which is arranged in the switch element 14. The switch element 14 can thereby be extended with the switch pin 24. A core 34 reinforces the magnetic field generated by the electromagnetic unit 31.

If the solenoid 32 has no current, the permanent magnet 33 interacts with the surrounding material. In the neutral position, the permanent magnet 33 interacts with the core 34 of the electromagnetic unit 31, which consists of a magnetizable material. In the switching position, the permanent magnet 33 interacts with the stator 22 of the actuator 15. In an operating state without current, the permanent magnet 33 stabilizes the switch element 14 in the switching position or the neutral position.

In an operating state in which the electromagnetic unit 31 is energized the permanent magnet 33 interacts with the field of the electromagnetic unit 31. An attracting force and a repelling force can thereby be realized in dependence on a polarization of the permanent magnet 33. A polarization of the electromagnetic unit 31 can be changed by means of flow the flow direction of a current, by which the electromagnetic unit 31 is energized. In order to extend the switch element 14 from its neutral position into the switch position, the electromagnetic unit 31 is energized by current of the current flow direction, in which the repellent force between the electromagnet unit 31 and the permanent magnet 33 results.

A spring unit 35 is further arranged in the actuator 15, which unit also exerts a force on the switch element 14. The force of the spring unit 35 is directed to a direction which corresponds to a direction of the repelling force between the electromagnetic unit 31 and the permanent magnet 33, whereby an extension action of the switch element 14 is accelerated.

The second actuator 17 is constructed analogously to the first actuator 15. It comprises an electromagnetic unit 36, which has a solenoid 37 arranged in a stator 22 designed commonly for both actuators 15, 17 with a magnetizable core 38, which interacts with a permanent magnet 39 arranged in the switch element 19 and which can extend the switch pin 26. An extension action is also accelerated with the actuator 17 by a spring unit 40.

The two actuators 15, 17 are arranged in a common base housing part 21, which simultaneously forms the stator 22 of the actuators 15, 17 formed in one piece. The solenoids 32, 37 of the actuators 15, 17 are also wound around the base housing part 21. A further housing part 41 is connected to the base housing part 31. The further housing part encloses both actuators 15, 17. The housing part 41 additionally comprises guides for the switch elements 14, 19.

The gate paths 25, 27, by means of which the cam elements 11, 12 are displaced, are designed as groove-shaped recesses and are brought directly into the cam elements 11, 12. In order to displace the cam elements 11, 12 sequentially, the cam elements 11, 12 are designed L-shaped and intersecting axially in a region in which they abut. In the circumferential direction, each cam element 11, 12 extends over a rotary angle of 180° degrees in the region of the gate paths 25, 27. The gate paths 25, 27 which extend over a rotational angle larger than 180°, are respectively partially arranged on the cam element 11 and partially on the cam element 12.

Figure 8:
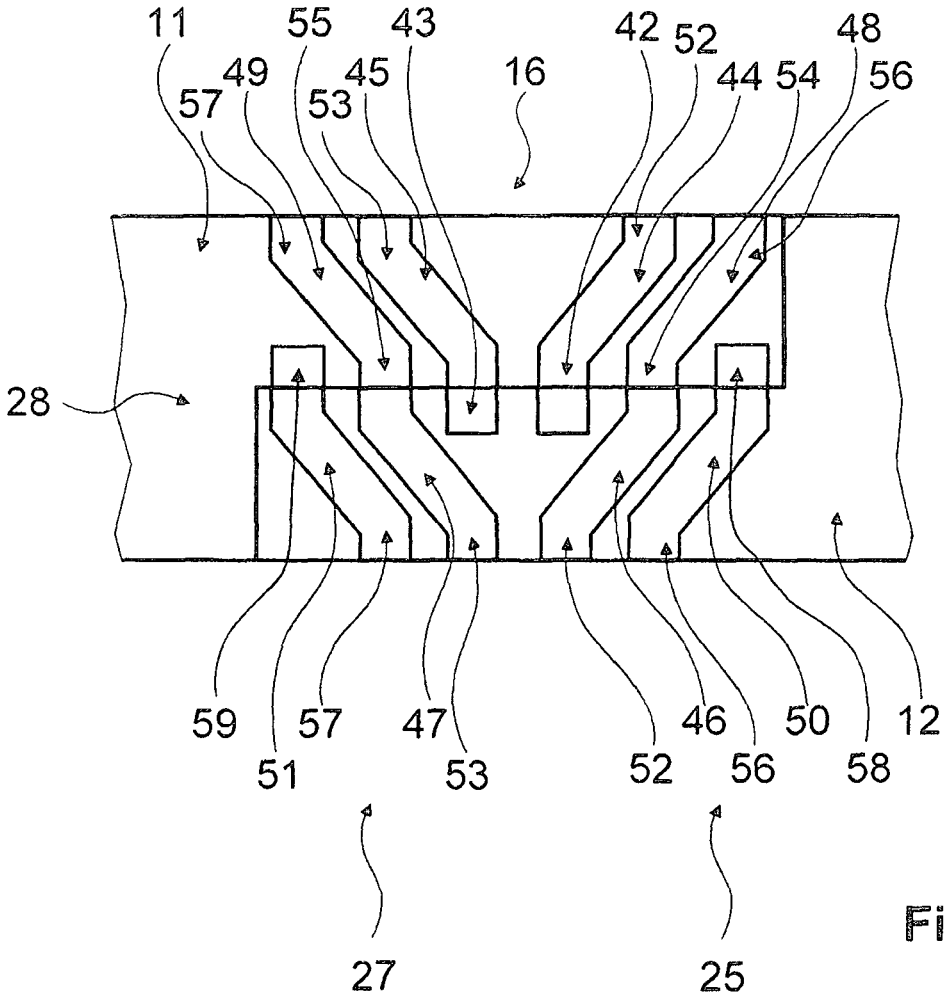

Both gate paths 25, 27 have a base form with a fourfold S-shaped structure (see FIG. 8). Both gate paths respectively have a meshing segment 42, 43, four switch segments 44-51, three intermediate segments 52-57 and a disengagement segment 58, 59. The switch segments 44, 46, 48, 50 of the first gate path 25 have an axial direction component which is opposed to the first switch direction, whereby an axial force for switching into the first switching direction can be generated by means of the switch segments 44, 46, 48, 50 and a rotary movement. The switch segments 45, 47, 49, 51 of the second gate path 27 have an axial direction component which is axially opposed to the second switching direction, whereby an axial force for switching into the second switching direction can be generated analogously.

In the first gate path 25, one of the switch segments 44, 46, 48, 50 and one of the intermediate segments 52, 54, 56 are successively arranged alternately following the meshing element 42, wherein the switch segment 44 immediately follows the meshing segment 42. The disengagement segment 58 is arranged immediately after the last switch segment 48. The meshing segment 42 has an increasing radial depth. The intermediate segments 52, 54, 56 and the switch segments 44, 46, 48 have a constant radial depth. The disengagement segment 58 has a decreasing radial depth. By means of the decreasing radial depth of the disengagement segment 58, the switch element 14 of the switch unit 13 is moved back into its neutral position, in which it is outside an engagement into the cam element shifting gate 16.

The meshing segment 42, the intermediate segments 52, 54, 56 and the disengagement segment 58 are respectively partially arranged on the cam element 11 and partially on the cam element 12. The switch elements 44, 46, 48, 50 are respectively arranged completely on one of the cam elements 11, 12, wherein successive switch segments 44, 46, 48, 50 are arranged alternately on the cam elements 11, 12. The switch segment 44 and the switch segment 48 are provided to displace the cam element 11. The switch segment 46 and the switch segment 50 are provided to displace the cam element 12.

The second gate path 27 is formed analogously to the first gate path 25. Following the meshing segment 43, one of the switch segments 45, 47, 49, 51 and one of the intermediate segments 53, 55, 57 are also arranged alternately, the disengagement segment 59 follows the last switch element 57 immediately. The meshing segment 43, the intermediate segments 53, 55, 57 and the disengagement segment 59 are respectively arranged partially on the cam element 11 and partially on the cam element 12. The switch segments 45, 47, 49, 51 are respectively arranged completely on one of the cam elements 11, 12, wherein successive switch segments 45, 47, 49, 51 are arranged alternately on the cam elements 11, 12 which they can displace.

Figure 9:
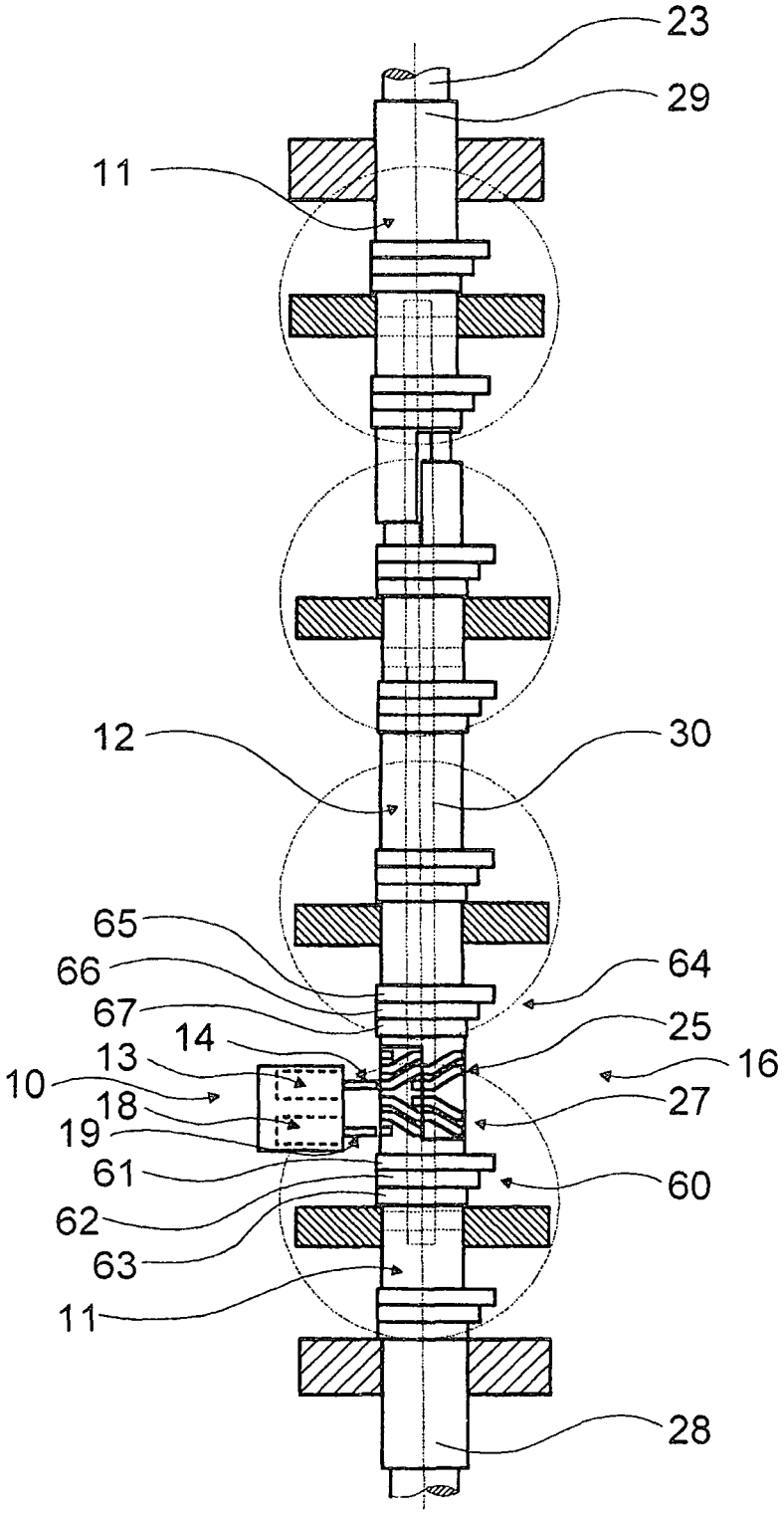

By means of the switch segments 44-51, three different switching positions of the cam elements 11, 12 can be switched (see FIG. 9). The cam element 11 and the cam element 12 respectively have at least one cam unit 60, 64 with three partial cams 61-63, 65-67. The partial cams 61-63, 65-67 have a different lift height and can be assigned to the switching positions of the cam elements 11, 12.

The partial cams 61, 65 with the highest lift height are assigned to the switching positions with a full lift. The partial cams 62, 66 with a median lift height are assigned to the switching positions with a partial lift. The partial cams 63, 67 with the lowest lift height, which is preferably equal to zero, are assigned to the switching positions with a zero lift. The partial cams 61, 65 with the highest lift height and the partial cams with the lowest lift height 63, 67 are arranged on the outside in the corresponding cam units 60, 64. The partial cams 62, 66 with the median lift height are arranged between the other partial cams 61, 63, 65, 67 of the corresponding cam unit.

In order to be able to withdraw the switch elements 14, 19 at a time that is independent of the disengagement segments 58, 59, the actuation device 10 has a coupling element 20, by means of which the first switch element 14 and the second switch element 19 are coupled in an interactive manner (see FIG. 6 and FIG. 7). The coupling element 20 couples the two switch elements 14, 19 in a complementary manner. The second switch element 19 can thereby be moved into the neutral position by means of the first actuator 15 and the first switch element 14 by means of the second actuator. The coupling element 20 thus forms a part of a reset unit 68, by means of which the switch elements 14, 19 can be moved back into the neutral positions and a switching action can thus be terminated prematurely.

The coupling element 20 is fixed between the switch elements 14, 19 in a pivotable manner. The two switch elements 14, 19 respectively have a recess 69, 70, into which the coupling element 20 engages. The switch elements 14, 19 are connected to each other in a movement-technical manner by means of the recesses 69, 70. The coupling element 20 thereby provides a rocking mechanism which couples the switch elements 14, 19 in a complementary manner.

The second switch element 19 is moved into the neutral position by means of the first actuator in that the first switch element 14 is moved into the switching position. The first switch element 14 is moved into the neutral position by means of the second actuator 17 in that the second switch element 19 is moved into the switching position. In principle, both switch elements 14, 19 can however also be moved back into the base position by means of the disengagement segments 58, 59. It is furthermore advantageous if the actuator 15, 17 of the switch element 14, 19, which is to be moved into neutral position, is additionally energized by current in the current flow direction, in which the electromagnetic unit exerts and attractive force and supports the movement of the switch element 14, 19 into the neutral position. By means of the actuation device 10, the cam element 11 can for example be switched into the switching position with partial lift and the cam element 12 into the switching position with zero lift. If both cam elements 11, 12 are in the switching position with zero lift, the switch element 14 of the first switch unit 13 is extended and engages the first gate path 25. By means of the switch segment 44 following the meshing segment 42, the cam element 11 is displaced from the switching position with zero lift into the switching position with partial lift. Subsequently, the switch element 19 of the second switch unit 18 is extended. The second switch element meshes into the disengagement segment 59 of the second gate path 27. The switch element 14 of the first switch unit 13 is thereby moved back into the neutral position. The switch element 19 of the second switch unit 18 is moved back into its neutral position by the disengagement segment 59.

Further possible switching actions, as for example a switching action that switches the cam element 11 into the switching position with a full lift and switches the cam element 12 into the switching position with zero lift, take place analogously to the above example and result directly from the description and the drawings, this is why a detailed description can be forgone here.

What is claimed is:

1. A valve train device for controlling the valve lift of an internal combustion engine including a camshaft with axially displaceable cam elements having overlapping sections provided each with first and second sets of cam element shifting gates, the first set for shifting the cam elements in one direction and the second set for shifting the cam elements in an opposite direction, a first actuator for engaging the first set of shifting gates in order to shift the cam elements in the first direction and a second actuator for engaging the second set of shifting gates in order to shift the cam elements in the opposite direction, the first set of each overlapping cam element sections having two parallel S-shaped shift gates extending axially between one end position and an intermediate position and the second set of S-shaped shift gates extending axially between the center position and the other end position, the first actuator, upon engagement with a first shifting gate of the first set of shifting gates of one cam element, moving the one cam element from one end position to the intermediate position in a first half turn of the camshaft and in a second half turn moving the other cam element from the one end position to the intermediate position and, upon further engagement, moving the cam elements sequentially from the intermediate position to the other end position.

2. The valve train device according to claim 1, wherein each cam element shifting gate has at least one intermediate segment for terminating a switching action of the cam elements in an intermediate position, the intermediate segment having a reset structure in the form of a ramp for moving a switch element of the switch unit into a neutral position out of engagement with the cam elements the intermediate segment having an increasing radial height in at least one partial section thereof.

3. The valve train device according to claim 2, wherein the intermediate segment has a groove with a radial minimum depth equal to a base path depth of the cam element shifting gate.

4. The valve train device according to claim 2, wherein the cam element shifting gate has at least one disengagement segment, for concluding a switching action.

5. The valve train device according to claim 4, wherein the disengagement segment and the intermediate segment are separated from each other.

6. The valve train device according to claim 4, wherein the cam element shifting gate has at least one switch segment, which is arranged between the disengagement segment and the intermediate segment.

7. The valve train device according to claim 1, wherein an actuation device comprises the first and second actuators has an electromagnetic actuator associated with a first switching unit for moving the first switch element into a neutral position.

8. The valve train device according to claim 7, wherein the first switch unit is provided for displacing the cam elements into the first direction.

9. The valve train device according to claim 7, wherein the actuation device has a second switch unit with a second switch element for engaging the cam element shifting gates.

10. The valve train device according to claim 9, wherein the second switch unit has an actuator, which is provided to move the second switch element into a switching position.

11. The valve train device according to claim 10, wherein the electromagnetic actuator of the second switch unit is designed at least partially in one piece with another actuator, which is provided to move the first switch element into the neutral position.

12. The valve train device according to claim 9, wherein the actuation device has a coupling element, for coupling the first switch element and the second switch element in an interactive manner.

13. The valve train device according to claim 9, wherein the first switch unit and the second switch unit are designed at least partially in one piece.

14. The valve train device according to claim 13, wherein the first switch unit and the second switch unit have a common stator.

15. The valve train device according to claim 1, wherein an actuation device is provided comprising the first and second actuators to switch the cam element in at least three switching positions.

* * * * *